US008348458B2

(12) United States Patent
Holten et al.

(10) Patent No.: US 8,348,458 B2
(45) Date of Patent: Jan. 8, 2013

(54) WHITE LIGHT-EMITTING DEVICE

(75) Inventors: Petrus Adrianus Josephus Holten, Eindhoven (NL); Vincent Fabriek, Eindhoven (NL); Giorgia Tordini, Eindhoven (NL); Rene Theodorus Wegh, Eindhoven (NL); Bart-hendrik Huisman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 62 days.

(21) Appl. No.: 12/934,696

(22) PCT Filed: Mar. 30, 2009

(86) PCT No.: PCT/IB2009/051303

§ 371 (c)(1),
(2), (4) Date: Sep. 27, 2010

(87) PCT Pub. No.: WO2009/122339

PCT Pub. Date: Oct. 8, 2009

(65) Prior Publication Data

US 2011/0026257 A1 Feb. 3, 2011

(30) Foreign Application Priority Data

Apr. 3, 2008 (EP) ..... 08154010

(51) Int. Cl.
*F21V 9/16* (2006.01)
*F21V 7/22* (2006.01)

(52) U.S. Cl. ..... 362/231; 362/84; 362/343

(58) Field of Classification Search ..... 362/84, 362/231, 293, 800, 343
See application file for complete search history.

(56) References Cited

U.S. PATENT DOCUMENTS

| | | | | |
|---|---|---|---|---|
| 6,234,648 | B1 * | 5/2001 | Borner et al. | 362/235 |
| 6,791,259 | B1 | 9/2004 | Stokes et al. | |
| 6,808,299 | B2 * | 10/2004 | Wijbenga et al. | 362/516 |
| 7,040,774 | B2 | 5/2006 | Beeson et al. | |
| 7,320,531 | B2 | 1/2008 | West et al. | |
| 7,382,091 | B2 * | 6/2008 | Chen et al. | 313/512 |
| 7,473,019 | B2 * | 1/2009 | Laski | 362/612 |
| 7,703,945 | B2 * | 4/2010 | Leung et al. | 362/246 |
| 7,837,348 | B2 * | 11/2010 | Narendran et al. | 362/231 |
| 7,942,556 | B2 * | 5/2011 | Harbers et al. | 362/294 |
| 8,142,051 | B2 * | 3/2012 | Ducharme | 362/249.02 |
| 2006/0072314 | A1 | 4/2006 | Rains | |
| 2007/0274096 | A1 | 11/2007 | Chew et al. | |
| 2007/0297179 | A1 | 12/2007 | Leung et al. | |

(Continued)

FOREIGN PATENT DOCUMENTS

EP 1574779 A1 9/2005

(Continued)

*Primary Examiner* — Peggy A. Neils
(74) *Attorney, Agent, or Firm* — John F. Salazar; Mark L. Beloborodov

(57) ABSTRACT

A light-emitting device comprises a light source adapted to emit light of a first wavelength range; a reflective body comprising a reflective layer; a wavelength converting layer comprising a wavelength converting material adapted to absorb light of said first wavelength range and to emit light of a second wavelength range, said wavelength converting layer and said light source being arranged mutually spaced apart; and light-scattering elements adapted to scatter light of at least said first wavelength range; wherein at least part of said light-scattering elements are arranged in the path of light from said light source to said wavelength converting layer. The light-emitting device according to the invention provides improved uniformity in color and also improved brightness uniformity.

5 Claims, 1 Drawing Sheet

U.S. PATENT DOCUMENTS

| | | | | |
|---|---|---|---|---|
| 2008/0198572 | A1* | 8/2008 | Medendorp | 362/84 |

FOREIGN PATENT DOCUMENTS

| | | | |
|---|---|---|---|
| JP | 10269820 | | 10/1998 |
| JP | 11224602 | | 8/1999 |
| WO | 0019546 | A1 | 4/2000 |
| WO | 03062700 | A1 | 7/2003 |
| WO | 2007054889 | A2 | 5/2007 |
| WO | 2007084421 | A2 | 7/2007 |
| WO | 2007130536 | A2 | 11/2007 |

* cited by examiner

WHITE LIGHT-EMITTING DEVICE

FIELD OF THE INVENTION

The invention relates to the field of light-emitting devices comprising a wavelength converting material arranged at a distance from a light source, and scattering elements.

BACKGROUND OF THE INVENTION

Light emitting diode (LED) based light-emitting devices are today increasingly used for a wide variety of lighting applications, including for instance office lighting luminaires, downlighters and retrofit lamps. White light may be obtained from an LED by using a blue LED and a wavelength converting material, sometimes referred to as a phosphor, which absorbs part of the blue light emitted by the LED and reemits light of longer wavelength(s). For reasons of efficacy it is preferable to have the wavelength converting material arranged at a distance from the LED. Usually, the wavelength converting material is applied on a substrate, which is for example arranged at the light exit window of the device. However, the adhesion of the wavelength converting material to the substrate often requires the use of a transparent coating film which may decrease the optical efficiency of the lighting device.

Since the light emitted by the wavelength converting material is emitted in all directions, a back reflector is generally used for reflect light emitted back into the optical chamber so that it is redirected towards the exit window. However, to provide a homogeneous white light output, the non-converted light, i.e., the blue light, must be effectively scattered as well. Usually, scattering of non-converted light is achieved by placing a diffuser at the exit window and/or using a diffusing back reflector. The use of an additional optical element, such as a diffuser, with reflections on all surfaces will however lead to a lower light output of the lighting device.

WO 2007/130536 discloses a lighting device which comprises solid state light emitters such as LEDs, a thermal conduction element and a reflective element. The lighting device may optionally include a lumiphor such as a phosphor. However, WO 2007/130536 does not provide a solution to the above-mentioned problem of adhesion of the phosphor.

Thus, there is a need in the art for improved LED-based lighting devices.

SUMMARY OF THE INVENTION

It is an object of the invention to provide an improved high efficacy LED-based light-emitting device which provides homogeneous white light output.

In one aspect, the invention relates to a light-emitting device comprising

- a light source adapted to emit light of a first wavelength range;
- a reflective body comprising a reflective layer, said reflective body being arranged to receive light emitted by said light source and to reflect said light towards a light exit window of the light-emitting device;
- a wavelength converting layer comprising a wavelength converting material adapted to absorb light of said first wavelength range and to emit light of a second wavelength range, said wavelength converting layer and said light source being arranged mutually spaced apart; and
- light-scattering elements adapted to scatter light of at least said first wavelength range;

- wherein at least part of said light-scattering elements are arranged in the path of light from said light source to said wavelength converting layer. Preferably, the light source comprises at least one light-emitting diode.

It has been found that by arranging light-scattering elements and the wavelength converting layer such that light from the light source is scattered before part of the light is converted by the wavelength converting material, improved uniformity in colour and also improved brightness uniformity is achieved, compared to the case of wavelength conversion before scattering of the non-converted light. Preferably the light-emitting device comprises a diffusing layer arranged in the path of light from said light source to said wavelength converting layer, said diffusing layer comprising at least part of said light-scattering elements.

In order to further improve the light mixing properties of the light-emitting device, the wavelength converting layer may comprise at least part of said light-scattering elements. By integrating light-scattering elements in the wavelength converting layer, further improved scattering of non-converted light is achieved, resulting in a higher output of homogeneous white light. Moreover, by including scattering elements in the wavelength converting layer, the optical path length of the light that is to be converted by the wavelength converting material in the wavelength converting layer is increased, making the conversion more efficient. As a result, less wavelength converting material may be used to achieve a certain level of wavelength conversion.

Furthermore, the reflective layer may comprise at least part of said light-scattering elements. In this way further scattering of non-converted light, and optionally also of converted light, is provided.

For example, the wavelength converting layer may be located in said light exit window.

Furthermore, the reflective body may comprise the wavelength converting layer, said wavelength converting layer being arranged in the path of light from said light source to said reflective layer. The reflective body may optionally further comprise said diffusing layer. By thus integrating the wavelength converting layer and optionally the diffusing layer in the reflective body, which is arranged in the interior of the light-emitting device, there is less need to protect the wavelength converting layer and/or the diffusing layer from mechanical damage, compared to when these layers are located at the exit window. The integrated arrangement may be thus advantageous since mechanical damage, such as scratches, in a body of wavelength converting and diffusing layers appear in different colours, which would be perceived as disturbing.

Preferably said reflective layer, said wavelength converting layer and, when present, said diffusing layer form a multi-layer film.

It has been found that by arranging a wavelength converting layer closely between the diffusing layer and the reflective layer, such as in a multi-layer film, very effective diffuse reflection is obtained. Since light emitted by the light source is scattered in the diffusing layer before entering the wavelength conversion layer and also after being reflected by the wavelength converting layer, the scattering of the reflected (both converted and non-converted) light is very effective. In particular, scattering of the non-converted light is improved compared to conventional light-emitting devices having a separate diffuser arranged at the exit window.

Moreover, by arranging a wavelength converting layer between the diffusing layer and the reflective layer, the wavelength converting layer is protected by the diffusing layer, resulting in the wavelength converting layer not being visible when the light emitting device is switched off. This is a major advantage, since the visibility of the coloured phosphor is generally perceived as a disadvantage of the application of a wavelength converting layer. The application of a diffusing layer on top of the wavelength converting layer provides scattering of white light in the diffusing layer and weakens the hindering color contrast.

Furthermore, arranging a wavelength converting layer between two other layers also allows for improving of the adhesion of the wavelength converting material. For example, the diffusing layer and/or the reflective layer may have an open structure providing enclosure of particles of wavelength converting material into the diffusing and reflective layers, thus avoiding a delamination after combining the layers.

It is to be noted that the present invention relates to all possible combinations of the appended claims.

Embodiments of the invention will now be described in detail with reference to the appended drawings.

DETAILED DESCRIPTION OF THE INVENTION

Figure 1:
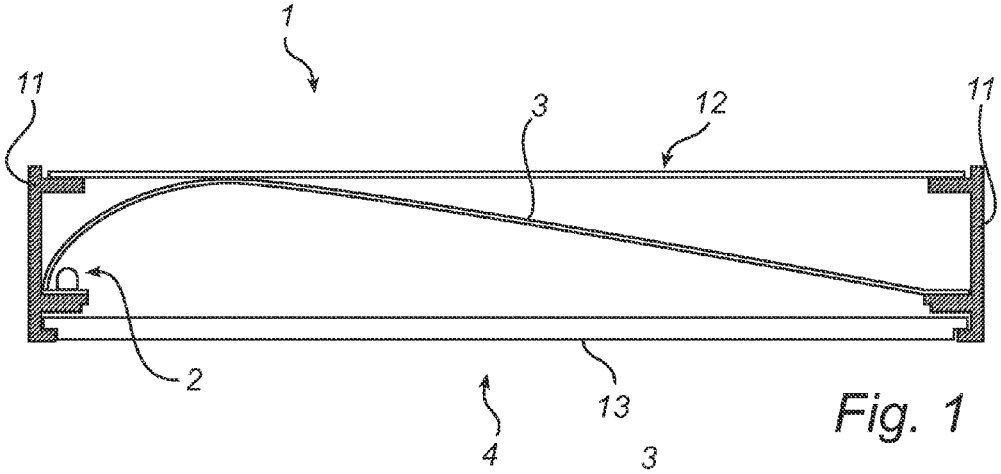
FIG. 1 is a a schematic cross-sectional view of a light-emitting device according to embodiments of the invention.

FIG. 1 shows a light-emitting device 1 comprising a light source 2, which is adapted to emit light of a first wavelength range. The light source is preferably adapted to emit blue light (wavelength range of about 400-500 nm); however, the light source may also emit light of other wavelengths, for example UV radiation and/or visible light of other colours such as green, yellow or red. Preferably, the light source 2 comprises at least one light-emitting diode (LED). Any type of conventional LED or combination of conventional LEDs may be used. Optionally, the light-emitting device may comprise a plurality of light sources.

Furthermore, a reflective body 3 is arranged to receive light emitted by the light source 2 and to reflect this light towards a light exit window 4 of the light-emitting device. The reflective body 3 may have any desired shape. For example, the reflective body 3 may have a flat shape. The reflective body 3 may also have a curved or concave shape. Optionally, the reflective body 3 may be partly transmissive.

Light may exit the light-emitting device 1 through the light exit window 4. The light exit window 4 may be open, or, as in FIG. 1, it may be at least partly covered by a translucent plate 13. The translucent plate 13 may be at least partly transparent. The translucent plate 13 may also have a diffusing function and/or a light beam shaping function (e.g. comprising an optical structure with lenses and/or prisms).

Optionally, when the reflective body 3 is partly light transmissive, light may also exit the light-emitting device 1 through a back area 12, which is located opposite the light exit window 4. The back area 12 may then be referred to as a second light exit window. The second light exit window may be open, or it may be at least partly covered by a translucent plate as described above for the light exit window 4. When the reflective body 3 is non-transmissive, the back area 12 may be a non-translucent back wall.

As is shown in FIG. 1, the reflective body 3 is located in a space defined by side walls 11, the light exit window 4 and the back area 12. The reflective body and optionally the side walls 11 may define a light mixing chamber. Light may exit the light mixing chamber through the light exit window 4 as described above. When the light-emitting device comprises a plurality of light sources, the light sources may be arranged at different locations in a space defined by the side walls 11, the light exit window 4 and the reflective body 3. Typically, the light sources are located close to the side walls 11, two opposite light sources being separated at least by a distance represented by the width of the light exit window. Thus, the reflective body 3 may receive light from different directions.

The light-emitting device 1 further comprises a wavelength converting layer comprising a wavelength converting material adapted to absorb light of a first wavelength range and to emit light of a second wavelength range. The wavelength converting layer and the light source 2 are arranged mutually spaced apart.

Furthermore, light-scattering elements adapted to scatter light of at least said first wavelength are arranged in the path of light from said light source 2 to the wavelength converting layer. The light-scattering elements are thus adapted scatter light that is emitted from the light source 2 and/or reflected by the reflective body 3 before said light enters the wavelength converting layer.

In a first embodiment of the invention, a wavelength converting layer is arranged in the light exit window 4. The wavelength converting layer comprises a wavelength converting material adapted to absorb light of a first wavelength range and to emit light of a second wavelength range. The wavelength converting layer may for instance be included in the translucent plate 13. Alternatively, the wavelength converting layer may be coated on the translucent plate.

In a second embodiment, the light emitting device 1 comprises a diffusing layer comprising said light-scattering elements. When present, such a diffusing layer is thus arranged in the path of light from the light source 2 to the wavelength converting layer. For example, when the wavelength converting layer is arranged in the light exit window 4, the diffusing layer may be comprised in the reflective body 3 so as to scatter light before and/or after it is reflected. Alternatively, the diffusing layer may be arranged at the light exit window 4 adjacent to the wavelength converting layer and in the path of light from the light source 2 to the wavelength converting layer.

In a third embodiment, the wavelength converting layer may comprise at least part of said scattering elements. For example, the wavelength converting layer may be prepared as an extruded polymer film comprising the wavelength converting material and scattering particles. Optionally, a wavelength converting layer comprising scattering elements may be combined with a separate diffusing layer comprising scattering elements arranged in the path of light from the light source to the wavelength converting layer as described above.

In a fourth embodiment, the reflective body 3 comprises a wavelength converting layer as described herein. Typically, the reflective body 3 also comprises at least one diffusing layer arranged in the path of light from the light source 2 to the wavelength converting layer.

Figure 4:
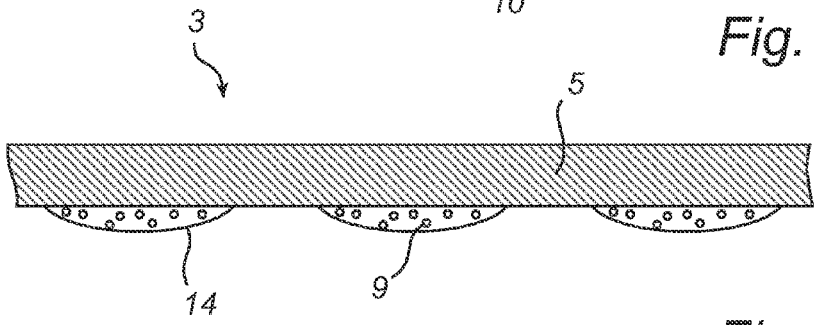
FIG. 4 is a a schematic cross-sectional view of a reflective body according to yet another embodiment of the invention.

In an fifth embodiment shown in FIG. 4, the reflective body 3 comprises defined domains 14 comprising wavelength converting material 9 arranged on a reflective layer 5. The reflective layer 5 may be diffusive.

When the reflective body 3 is partly transmissive, it may optionally comprise an additional wavelength converting layer and/or an additional diffusing layer. Said additional wavelength converting layer and/or said additional diffusing layer is/are preferably arranged on a side of the reflective body 3 facing away from the light source 2. Preferably, said additional diffusing layer is arranged in the path of light from the light source 2 to said additional wavelength converting layer, when present.

Figure 2:
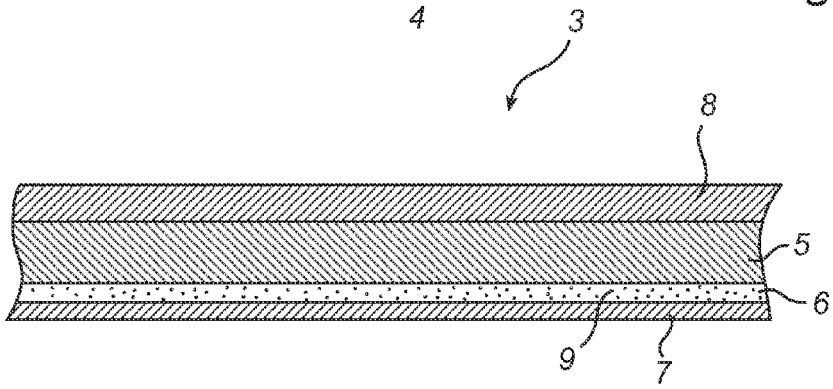
FIG. 2 is a a schematic cross-sectional view of a reflective body according to an embodiment of the invention.
Figure 3:
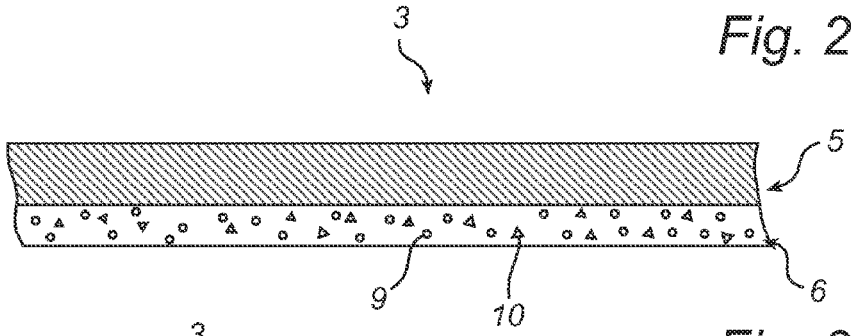
FIG. 3 is a a schematic cross-sectional view of a reflective body according to another embodiment of the invention.

FIGS. 2 and 3 illustrate a reflective body according to embodiments of the invention.

In FIG. 2, the reflective body 3 comprises a diffusing layer 7 and a wavelength converting layer 6 arranged on a reflective layer 5. The reflective layer 5, the wavelength converting layer 6 and the diffusing layer 7 form a multi-layer reflective film. The wavelength converting layer 6 is arranged between the diffusing layer 7 and the reflective layer 5, in the path of light from the light source to the reflective layer 5. Consequently, the diffusing layer 7 is arranged in the path of light from the light source to the wavelength converting layer 6.

The diffusing layer 7 is adapted to receive and scatter light emitted by the light source. The diffusing layer 7 may comprise light-scattering elements, for instance scattering particles, or pores formed in a carrier material. The carrier material may be a polymer, such as PET, PMMA or PC. Examples of scattering particles include titanium dioxide, zirconium dioxide and aluminium oxide particles. For example, the diffusing layer 7 may comprise light-scattering particles dispersed in a carrier material at a concentration in the range of from 1 to 75% w/w, preferably from 2 to 20% w/w.

Optionally, at least a part of the scattering elements may be adapted to differently scatter light of different wavelengths. For example, the scattering elements may be adapted to scatter non-converted light only (i.e., light of said first wavelength range).

The diffusing layer 7 is at least partly transmissive in order to allow a major part of the light from the light source to reach the wavelength converting layer 6. Preferably, the diffusing layer 7 is very thin, such as having a thickness in the range of from 0.5 to 100 μm, preferably from 2 to 25 μm.

The diffusing layer 7 may serve to mechanically protect the wavelength converting layer 6 and to hide it from sight, while also improving the mixing of converted and non-converted light.

The wavelength converting layer 6 comprises a wavelength converting material 9, such as a material commonly known as a phosphor. The wavelength converting material 9 is adapted to absorb light of a first wavelength range and to emit light of a second wavelength range. For example, the wavelength converting material may absorb blue light (wavelength range of about 400-500 nm) and emit light of longer wavelengths, for example in the yellow light wavelength range. Examples of suitable wavelength converting materials include $Y_3Al_5O_{12}$:Ce, $CaAlSiN_3$:Eu and CaS:Eu. Additional suitable wavelength converting materials are known to persons skilled in the art.

Typically, a part of the light of said first wavelength range emitted by the light source 2 is transmitted through the wavelength converting layer 6 without being absorbed by the wavelength converting material 9.

The wavelength converting layer 6 may have a thickness in the range of from 5 to 2000 μm, preferably from 10 to 50 μm. The wavelength converting layer 6 may comprise an amount of wavelength converting material per unit area in the range of from 5 to 200 g/m$^2$, preferably from 10 to 100 g/m$^2$.

In embodiments of the invention the wavelength converting layer 6 does not form part of a multi-layer film, but may be a substrate formed by e.g. extrusion or injection moulding. In such embodiments, the diffusing layer 7 and the reflective layer 5 may be coated on opposite sides of the wavelength converting substrate 6.

The reflective layer 5 is adapted to receive light that is transmitted through the wavelength converting layer 6 and to reflect it back into the wavelength converted layer 6, where the light is further transmitted into the diffusing layer 7, possibly after being converted as described above. Preferably the reflective layer 5 is a diffusing reflector; however, in embodiments of the invention, the reflective layer 5 may be a specular reflector. The reflective layer 5 preferably is a polymer based white reflective film, e.g. a PET based white reflective film. Several such reflective materials are known in the art. The reflective film 5 may have a thickness in the range of from 5 to 2000 μm, preferably from 20 to 800 μm.

In embodiments of the invention the reflective layer 5 does not form part of a multi-layer film, but may be a reflective substrate formed by e.g. extrusion or injection moulding. In such embodiments, the diffusing layer 7 and the wavelength converting layer 6 may be coated on the reflective substrate. Alternatively, the diffusing layer 7 may form a substrate on which the wavelength converting layer 6 and the reflective layer 5 are coated as described above. In embodiments of the invention, such as light-emitting devices adapted for emitting a part of the light through the back area (a second light exit window), an additional wavelength converting layer and optionally an additional diffusing layer may be arranged on a side on the reflective layer 5 facing away from the light source.

The reflective layer 5 may contain scattering elements as described above. When it is desirable to achieve complete reflection of light, the reflective layer 5 preferably comprises scattering particles at a concentration that is higher than that of the diffusing layer 7. However, if a part of the light received by the reflective body is to be transmitted, the reflective layer 5 may have a concentration of scattering particles that is approximately the same, or at least in the same range, as that of the diffusing layer 7.

Furthermore, the total thickness of the diffusing layer 7, the wavelength converting layer 6 and the reflective layer 5 may be in the range of from 0.01 to 4 mm, preferably from 0.1 to 1 mm.

The reflective body 3 may further comprise a substrate 8 for improving the reflectivity of the reflective body 3. The substrate 8 may be reflective. The reflection factor of the reflective body 3 is influenced by the thickness of the reflective body, and in particular by the thickness of the reflective layer 5. For example, if the diffusing reflective layer 5 is very thin, a part of the light received by the reflective layer 5 from the wavelength converting layer 6 is diffusively transmitted rather than diffusively reflected. In embodiments of the invention, it is desired to achieve a reflection factor of at least 0.85, preferably at least 0.95. By arranging the reflective layer 5 on a substrate 8, the reflectivity of a relatively thin film may thus be improved.

In some applications, it may be preferable to have a certain degree of light transmittance through the reflective body 3, e.g. in a luminaire having both an upward and a downward lighting component. Thus, in some embodiments of the invention, the substrate 8 is thus preferably omitted, or is made of a translucent material.

The reflective body of FIG. 2 provides improved mixing of light of different wavelengths; in particular, this embodiment provides improved scattering of non-converted light (that is, light of the first wavelength range). A mixture of wavelength converted light and well-scattered, non-converted light may exit the reflective body 3 through the diffusing layer 7 in the direction of the light exit window. However, embodiments of the invention in which light is transmitted through the reflective layer 5 as described above provides excellent mixing of light in this direction as well, resulting in a homogeneous white light output in both directions.

The multi-layer reflective film shown in FIG. 2 may be produced by preparing the individual layers and subsequently combining these layers into a film by lamination. For example, the wavelength converting layer and the diffusing layer 7 can be coated on a carrier film for subsequent lamination onto the reflective layer 5. Alternatively, the wavelength converting layer and the diffusing layer 7 can be coated directly on the reflective layer 5 by means of any suitable conventional coating technique, such as spray coating, slid-coating, transfer coating, printing etc. The wavelength converting layer can also be prepared by e.g. extrusion, vacuum/thermo forming, injection moulding resulting in a plate, in which case the other layers could be applied by lamination onto or direct coating on the plate. The diffusing layer 7 and/or the reflective layer 5 may have an open structure providing enclosure of particles of wavelength converting material 9 in the wavelength converting layer 6 into the layers 7 and 5, thus improving the adhesion of the layers to the wavelength converting layer 6.

In the embodiment illustrated in FIG. 3, the reflective body 3 is a multi-layer film comprising a wavelength converting layer 6 and a reflective layer 5. The wavelength converting layer 6 is adapted to receive light emitted by the light source. The wavelength converting layer 6 is adapted to absorb and reemit light as described above. Furthermore, the wavelength converting layer 6 generally transmits a part of the light emitted by the light source as described above.

In addition to the wavelength converting material 9, the wavelength converting layer 6 comprises light-scattering elements 10. Hence, the wavelength converting layer 6 also serves as a diffusing layer. The light-scattering elements 10 may be as described above. In embodiments of the invention, the wavelength converting layer thus comprises a mixture of wavelength converting material and scattering particles dispersed in a carrier material. For example, the wavelength converting layer 6 may comprise light-scattering particles at a concentration of 1 to 50% w/w, preferably from 2 to 20% w/w. The wavelength converting layer may comprise an amount of wavelength converting material per unit area in the range of from 5 to 200 g/m$^2$, preferably from 10 to 100 g/m$^2$.

The wavelength converting layer of the embodiment of FIG. 3 may have a thickness in the range of, for example, from 5 to 2000 μm, and preferably from 10 to 50 μm.

The reflective layer 5 may be as described above. In particular, it may be a specular reflector. When the reflective layer 5 is a diffusing reflective layer, it may comprise light-scattering elements as described above.

The total thickness of the multi-layer film of FIG. 3 (i.e, the wavelength converting layer 6 and the reflective layer 5) may be in the range of from 0.01 to 4 mm, preferably from 0.1 to 1 mm.

It is to be noted that the embodiments of the invention described above are exemplary and not limitative of the scope of the invention.

The invention claimed is:

1. A light-emitting device having a light exit window, the device comprising a light emitting diode for emitting light in a first wavelength range;

a reflective body comprising defined domains comprising wavelength converting material arranged on a reflective layer, said reflective body being arranged to receive light emitted by said light emitting diode and to reflect said light towards the light exit window;

a wavelength converting layer comprising the wavelength converting material for absorbing light of said first wavelength range and to emit light of a second wavelength range, said wavelength converting layer and said light emitting diode being mutually spaced apart; and a plurality of light-scattering elements for scattering light of at least said first wavelength range; wherein at least a portion of said plurality of light-scattering elements are arranged in the path of light from said light emitting diode to said wavelength converting layer;

said reflective body further comprises said wavelength converting layer, said wavelength converting layer being arranged in the path of light from said light source to said reflective layer;

said reflective body further comprises a diffusing layer arranged in the path of light from said light emitting diode to said wavelength converting layer, said diffusing layer comprising at least said portion of said plurality of light-scattering elements; and said reflective layer, said wavelength converting layer, and said diffusing layer form a multi-layer film.

2. The light-emitting device according to claim 1, wherein said wavelength converting layer further comprises at least some of said light-scattering elements.

3. Light-emitting device according to claim 1, wherein said reflective layer comprises at least some of said light-scattering elements.

4. A light-emitting device having a light exit window, the device comprising a light emitting diode for emitting light in a first wavelength range;

a reflective body comprising defined domains comprising wavelength converting material arranged on a reflective layer, said reflective body being arranged to receive light emitted by said light emitting diode and to reflect said light towards the light exit window;

a wavelength converting layer comprising the wavelength converting material for absorbing light of said first wavelength range and to emit light of a second wavelength range, said wavelength converting layer and said light emitting diode being mutually spaced apart; and a plurality of light-scattering elements for scattering light of said first wavelength range and incapable of scattering light of said second wavelength range;

wherein at least a portion of said plurality of light-scattering elements are arranged in the path of light from said light emitting diode to said wavelength converting layer;

said reflective body further comprises said wavelength converting layer, said wavelength converting layer being arranged in the path of light from said light source to said reflective layer;

said reflective body further comprises a diffusing layer arranged in the path of light from said light emitting diode to said wavelength converting layer, said diffusing layer comprising at least said portion of said plurality of light-scattering elements;

said reflective layer, said wavelength converting layer, and said diffusing layer form a multi-layer film.

5. A light-emitting device having a light exit window, the device comprising a light emitting diode for emitting light in a first wavelength range;

a reflective body comprising defined domains comprising wavelength converting material arranged on a reflective layer, said reflective body being arranged to receive light emitted by said light emitting diode and to reflect said light towards the light exit window;

a wavelength converting layer comprising the wavelength converting material for absorbing light of said first wavelength range and to emit light of a second wavelength range, said wavelength converting layer and said light emitting diode being mutually spaced apart; and a plurality of light-scattering elements for scattering light of said first wavelength range and incapable of scattering light of said second wavelength range;

wherein at least a portion of said plurality of light-scattering elements are arranged in the path of light from said light emitting diode to said wavelength converting layer;

said reflective body further comprises said wavelength converting layer, said wavelength converting layer being arranged in the path of light from said light source to said reflective layer;

said reflective body further comprises a diffusing layer arranged in the path of light from said light emitting diode to said wavelength converting layer, said diffusing layer comprising at least said portion of said plurality of light-scattering elements;

said reflective layer including at least a portion of said plurality of light scattering elements at a concentration greater than a concentration of said light scattering elements in said diffusing layer;

said reflective layer, said wavelength converting layer, and said diffusing layer form a multi-layer film.

* * * * *